US006311622B1

(12) United States Patent
Adimari et al.

(10) Patent No.: US 6,311,622 B1
(45) Date of Patent: Nov. 6, 2001

(54) SELF-DESTRUCT FUZE FOR MUNITIONS

(75) Inventors: Louis J. Adimari, Montague; Joseph A. Donini, Dover, both of NJ (US); Keith R. Fulton, Stroudsburg, PA (US); Marc E. Ball, Columbia, PA (US); Edward F. Cooper, New Providence, PA (US); John R. Hertzler; John C. Yoo, both of Lancaster, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/511,641

(22) Filed: Feb. 22, 2000

Related U.S. Application Data

(60) Provisional application No. 60/128,431, filed on Apr. 5, 1999.

(51) Int. Cl.[7] ..... F42C 15/20
(52) U.S. Cl. ..... 102/259
(58) Field of Search ..... 102/259, 226

(56) References Cited

U.S. PATENT DOCUMENTS

| | | | | |
|---|---|---|---|---|
| 3,610,154 | * | 10/1971 | Brown | 102/202 |
| 3,633,510 | * | 1/1972 | Bernardin | 102/254 |
| 3,636,880 | * | 1/1972 | Aske | 102/236 |
| 3,707,912 | * | 1/1973 | Duncan et al. | 102/397 |
| 3,742,854 | * | 7/1973 | Donahue et al. | 102/397 |
| 4,765,245 | * | 8/1988 | Berube et al. | 102/251 |
| 5,387,257 | | 2/1995 | Tari et al. | 102/223 |
| 5,932,834 | * | 8/1999 | Lyone et al. | 102/226 |
| 6,082,267 | * | 7/2000 | Cooper | 102/487 |
| 6,237,495 | * | 5/2001 | Hok et al. | 102/245 |

* cited by examiner

*Primary Examiner*—Peter M. Poon
*Assistant Examiner*—J Lofdahl
(74) *Attorney, Agent, or Firm*—John F. Moran; Michael C. Sachs

(57) ABSTRACT

A secondary self-destruct fuze that functions in the event the primary fuze mode fails to function, and that meets the design requirements for a low cost, highly producible no-spin/low velocity operating environment. The fuze includes a bottom plate, two spacers, a firing pin, a striker, a rotor, a pyrotechnic mix, a rotor spring, a striker spring, a weight with a firing pin, a weight spring, a bore rider, a bore rider spring, a housing, a handling safety pin, and a ribbon retainer. In use, the handling safety pin is removed upon loading of the grenade in the main carrier. When the grenade is ejected, the expulsion event forces the ribbon retainer to be uncovered and the ribbon to unfurl, which releases the safety lock feature. The unfurling of the ribbon in the air stream stabilizes the grenade by causing an upward pull force. Simultaneously, the air stream forces the bore rider and the bore rider spring out of the fuze. In addition, the upward pull force translates to the weight firing pin and causes the latter to move up and away from the rotor. Both the rotor and the striker are free to move under the action of their respective springs. The burning of the pyrotechnic mix is initiated by the striker firing pin hitting the match tip at the open end of the channel in the rotor. After a predetermined delay, the detonator is functioned. In the meantime, the rotor, together with the striker have moved into their respective in-line positions. Upon impact, the firing pin of the weight is forced into the detonator, thereby igniting the lead charge of the grenade.

20 Claims, 11 Drawing Sheets

SELF-DESTRUCT FUZE FOR MUNITIONS

RELATED APPLICATIONS

This application claims benefit of filing date Apr. 5, 1999 of provisional application No. 60/128,431, the entire file wrapper contents of which application are herewith incorporated by reference as though fully set forth herein at length.

GOVERNMENT INTEREST

The invention described herein may be manufactured and used by or for the Government of the United States for governmental purposes without the payment of any royalties thereon.

FIELD OF THE INVENTION

The present invention relates to the field of munitions, and more particularly to an improved design for a secondary self-destruct fuze that functions in the event the primary fuze mode fails to function, and that meets the design requirements for a low cost, highly producible no-spin/low velocity operating environment.

BACKGROUND OF THE INVENTION

Dual Purpose Improved Conventional Munitions (DPICM) must have either a self-destruct capability or they must show dud rates not to exceed 1 in 500 as an operational requirement. Conventional designs proposed the development of a hybrid electromechanical fuze which is relatively complex with approximately 40 to 50 parts, with a costly production line. In addition, the no-spin/low velocity operational environments of grenades jeopardize the fuze reliability. Several projectiles have unique operational requirements that the current fuze design might not meet readily.

Some of the concerns facing current self-destruct fuze designs are listed below:

(1) The threads between the arming screw and the weight can be overtorqued.

(2) The fuze components may suffer collateral damage during ejection from the carrier.

(3) The fuze may impact the ground at oblique angles and the firing pin might not provide sufficient energy to the detonator.

(4) The fuze may operate poorly in a no-spin/low velocity environment.

Therefore, there is a still unsatisfied need for a fuze which, among other features, solves the no-spin/low velocity environment, significantly reduces the number of components, improves productivity, and increases the operational reliability of the primary arming mode.

Several engineering studies were conducted in the past two decades in an attempt to address the low reliability of existing mechanical fuzes. Although these 'mechanical only' solutions did improve the overall functional reliability of the fuze, there is still room for an improved design that fully addresses the no-spin/low velocity operational environment, and that significantly reduces the dud rate to the present ordnance requirements for self destruct fuzing of grenades.

A design that proposes a secondary self-destruct electrical mode of operation is described in U.S. Pat. No. 5,387,257. While the patented fuze provides an improvement in the relevant field, the activation of this self-destruct mode requires forces that are not available from no-spin/low velocity environment.

SUMMARY OF THE INVENTION

The present invention contemplates an improved design for a secondary self-destruct fuze that functions in the event the primary fuze mode fails to function, and that meets the design requirements for a low cost, highly producible no-spin/low velocity operating environment.

The fuze offers several features and advantages, among which are the following:

(1) It significantly simplifies conventional designs and the production process.

(2) It solves the functional reliability problems when operating in a no-spin/low spin environment.

(3) It uses a unique low cost mechanical/pyrotechnic design to provide a high functional reliability, in almost all operating environments.

(4) Its components and assemblies are made of readily available materials and are fabricated from stampings, die casting and precision molds.

(5) It meets all MIL-STD-1316D standards.

(6) It is compatible with almost all grenade configurations.

(7) It provides a self destruct delay of between 30–45 seconds.

(8) Its threads can be removed from a firing pin/weight and replaced by a one-piece threadless firing pin.

(9) It includes a mild firing pin spring, a heavier firing pin/weight, and a rotor lock out arming tab that mitigate the problem of grenade impact at oblique angles onto the ground.

The foregoing and other features and advantages of the present invention are realized by a fuze that includes the following components: a bottom plate, two spacers, a firing pin, a striker, a rotor, a pyrotechnic mix, a rotor spring, a striker spring, a weight with a firing pin, a weight spring, a bore rider, a bore rider spring, a housing, a handling safety pin, and a ribbon retainer. As it can be appreciated, the present fuze includes a minimal number of components.

In use, the handling safety pin is removed upon loading of the grenade in the main carrier. When the grenade is ejected in the air, the expulsion event forces the ribbon retainer to be uncovered and the ribbon to unfurl, which releases the safety lock feature. The unfurling of the ribbon in the air stream stabilizes the grenade by causing an upward pull force. Simultaneously, the air stream forces the bore rider, as well as the bore rider spring out of the fuze.

In addition, the upward pull force caused by the unfurling of the ribbon translates down to the weight firing pin and causes the latter to move up and away from the rotor. Both the rotor and the striker are free to move under the action of their respective springs. The burning of the pyrotechnic mix is initiated by the striker firing pin hitting the match tip (miniature detonator) at the open end of the channel in the rotor. After a delay of approximately 30–45 seconds, the main detonator (i.e., M55 detonator) is functioned. In the meantime, the rotor, together with the striker, have moved into their respective in-line positions. Upon impact, the firing pin of the weight is forced into the detonator, thereby igniting the lead charge of the grenade. This is the primary mode of operation. The secondary/self-destruct mode is the initiation of the main detonator by the burning of the pyrotechnic mix.

If, for any reason, the primary mode fails to function the grenade, the grenade is rendered safe to handle by the secondary/self destruct mode which sterilizes the main detonator.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items.

DETAILED DESCRIPTION OF THE INVENTION

Figure 1:
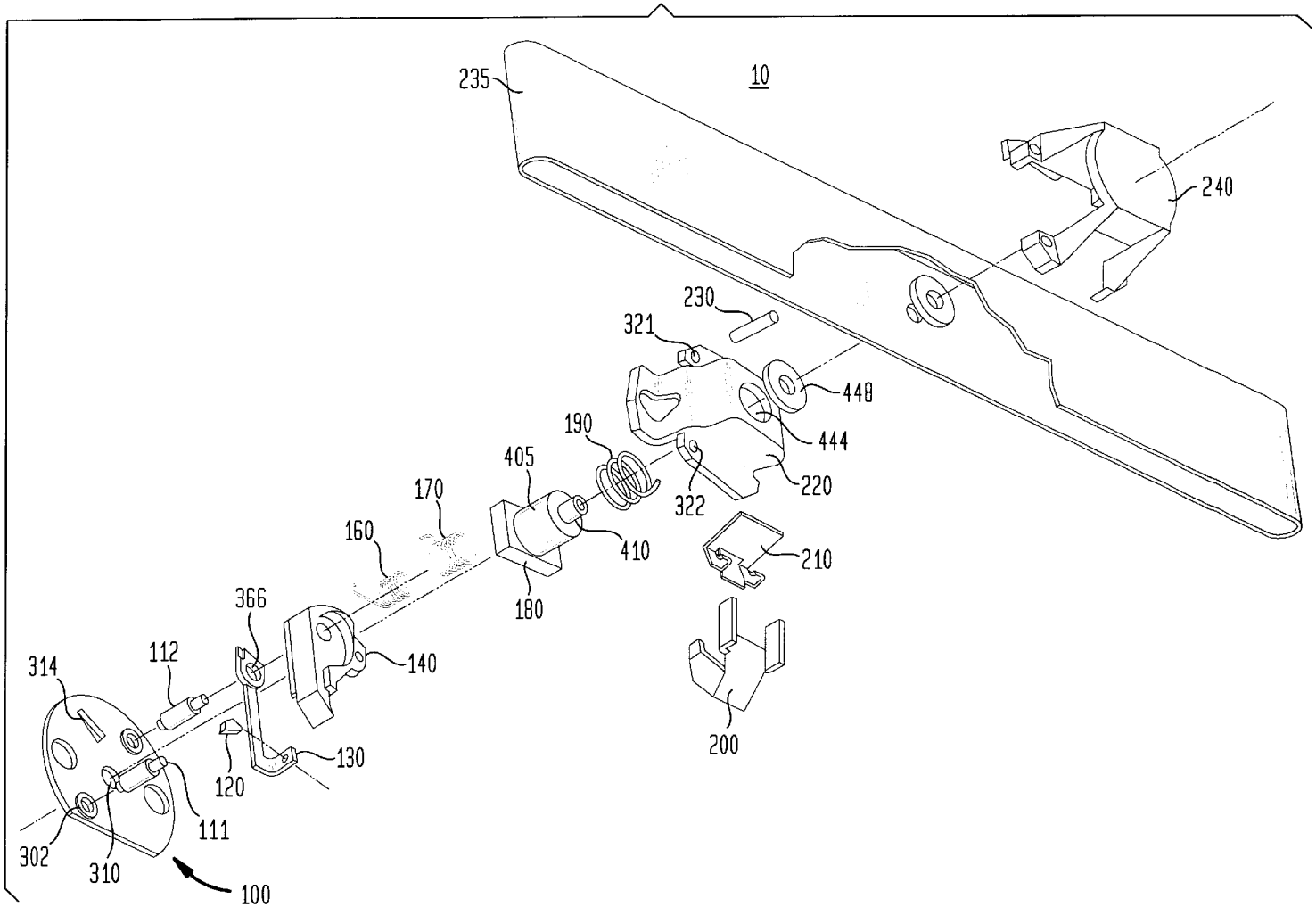
FIG. 1 is an exploded view of a fuze according to the present invention.

FIG. 1 illustrates a fuze 10 according to the present invention. The fuse 10 includes the following components: a bottom plate 100 made for example of stainless steel and prepared by means of a stamping process; two spacers 111 and 112 composed for example of aluminum posts and prepared by means of a machining process; a firing pin 120 made for example of stainless steel and prepared by means of a machining process; a striker 130 made for example of stainless steel and prepared by means of a stamping process; a rotor 140 made for example of polycarbonite and prepared by means of a molding process; a pyrotechnic mix 150 (FIG. 3A) which is composed as a delay energy material; a rotor spring 160 such as a spring steel winding, which is made of a resilient material; a striker spring 170 such as a spring steel winding, which is made of a resilient material; a weight 180 with a firing pin 185 (FIG. 4) made for example of stainless steel and prepared by means of a machining process; a weight spring 190 such as a spring steel winding, which is made of a resilient material; a bore rider 200 made for example of stainless steel and prepared by means of a stamping process; a bore rider spring 210 made for example of a resilient material such as spring steel, and prepared by means of a stamping process; a housing 220 made for example of stainless steel and prepared by means of a stamping process; a handling safety pin 230 made for example of rolled stainless steel; a ribbon 235; and a ribbon retainer 240 made for example of a plastic material and prepared by means of a molding process.

The bottom plate 100 secures the rotor 140, the striker 130, and the weight 180 inside the housing 220 at the bottom of the fuze 10. The striker 130 and the rotor 140 rotate along the top surface of the bottom plate 100. The bottom plate 100 has a lock out tab protruding towards the rotor that prevents the return movement of the rotor 140 after the rotor 140 has moved into the in-line position.

The spacers 111, 112 are staked into the bottom plate 100. The firing pin 120 forms part of the striker 130, and rotates along with the striker 130 into the rotor 140 forcing the firing pin 120 to strike the match tip of the pyrotechnic mix 150. The striker spring 170 provides the torsion force to drive the striker 130. The rotor 140 is also able to rotate and move into the firing pin 120. The rotor spring 160 provides the torsion force to drive the rotor 140. The weight 180 includes the primary firing pin to initiate the armed and in-line M55 Detonator providing the primary mode of operation.

The weight 180 is initially retained by the bore rider 200, and is free to move after the bore rider 200 is removed from the fuze 10. The weight 180 also prevents the rotor 140 from moving into the armed in-line position. The weight spring 190 facilitates the loading of the bore rider 200 into the fuze housing 220 by trapping the weight 180 down on to the rotor 140. The weight spring 190 contributes to the downward force needed to initiate the M55 Detonator FIG. 3B.

Figure 9:
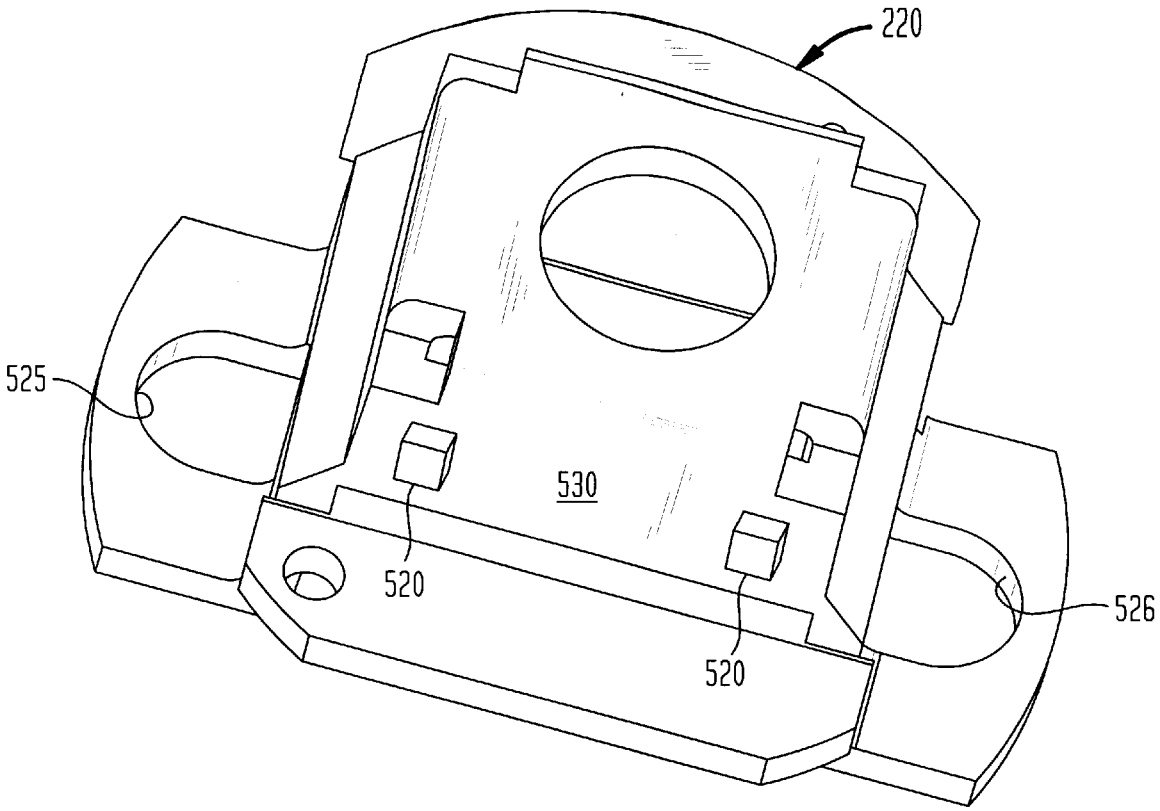
FIG. 9 is an enlarged top, perspective view of a housing forming part of the fuze of FIG. 1.
Figure 10:
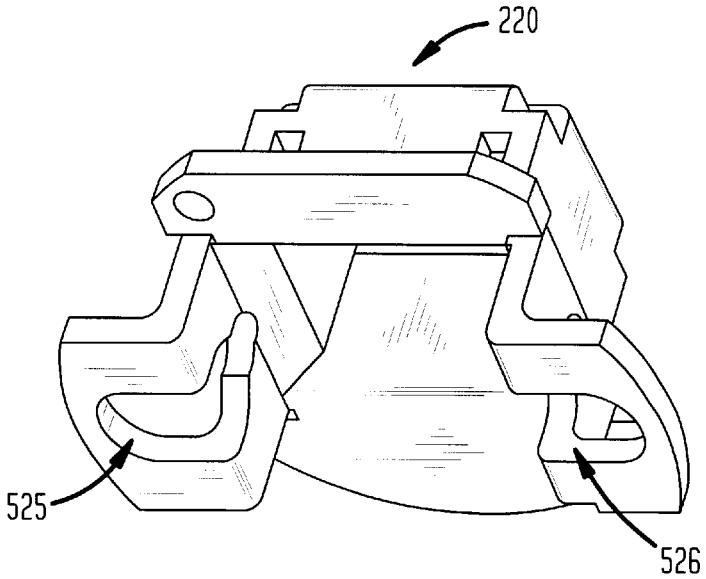
FIG. 10 is a bottom, perspective view of the housing of FIG. 9.
Figure 11:
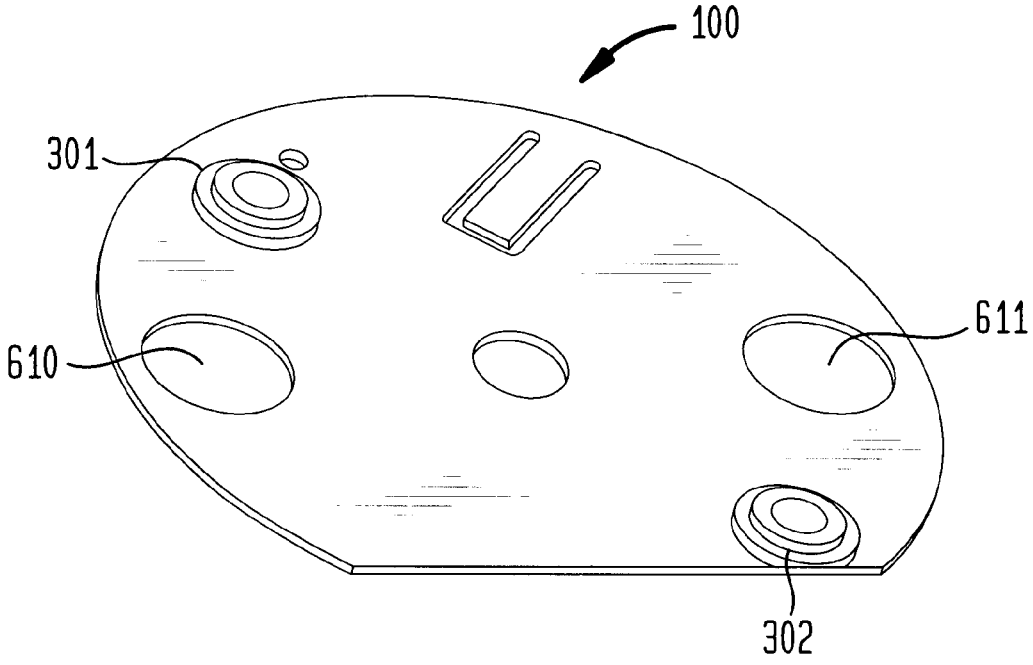
FIG. 11 is a perspective view of a bottom plate forming part of the fuze of FIG. 1.

The bore rider 200 slides into two slots 520, 521 (FIG. 9) in the fuze housing 220 and prevents the movement of the rotor 140 and the weight 180. The bore rider 200 is contained by the bore rider spring 210. The bore rider 200 is removed in the air by the force of the air stream and is released from the fuze 10 together with the bore rider spring 210.

The fuze housing 220 is one of the main structural components of the fuze 10 and houses all of the fuze components. The fuze housing 220 is staked to the grenade 262. The handling safety pin 230 is used for both interplant shipment of the complete fuze 10 to the ammunition load plant, and for safety and handling during staking to the grenade 262. The ribbon retainer 240 is a safety lock that locks out the movement of the rotor 140 and the striker 130. The ribbon retainer 240 also covers and protects the ribbon 235 during loading and at grenade ejection from the carrier.

Figure 8:
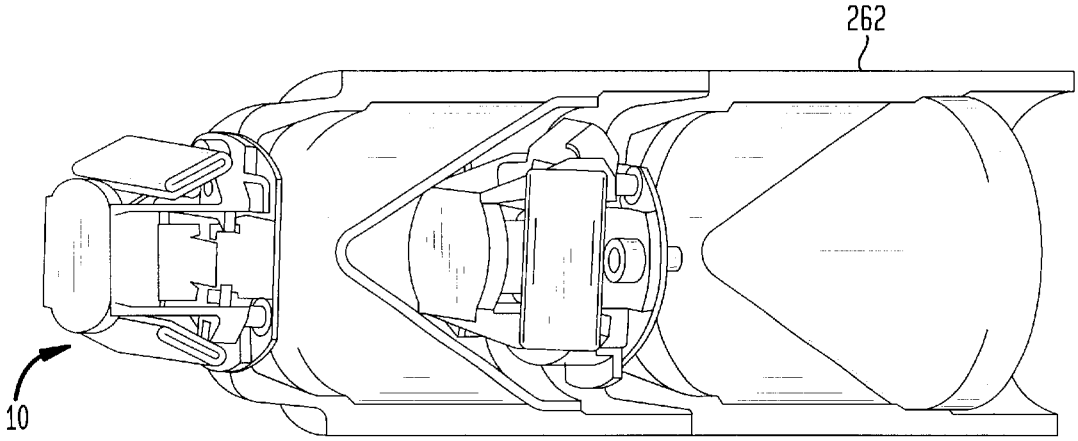
FIG. 8 is sectional view of the fuze of FIG. 1, shown assembled to a Dual Purpose Improved Conventional Munitions (DPICM).

In use, the fuze 10 is secured to a grenade 262 (FIG. 8) or any other Dual Purpose Improved Conventional Munitions (DPICM) by means of staking of the grenade studs. The handling safety pin 230 of the fuze 10 is removed upon loading of the grenade 262 in a main carrier (not shown). When the grenade 262 is ejected in the air, the expulsion event forces the ribbon retainer 240 to be uncovered and the ribbon 235 to unfurl, which releases the safety lock feature that prevented movement of the primary and secondary modes of operation. The unfurling of the ribbon 235 in the air stream stabilizes the grenade 262 by causing an upward pull force. Simultaneously, the air stream forces the bore rider 200, as well as the bore rider spring 210 away from the housing 220.

Figure 3:
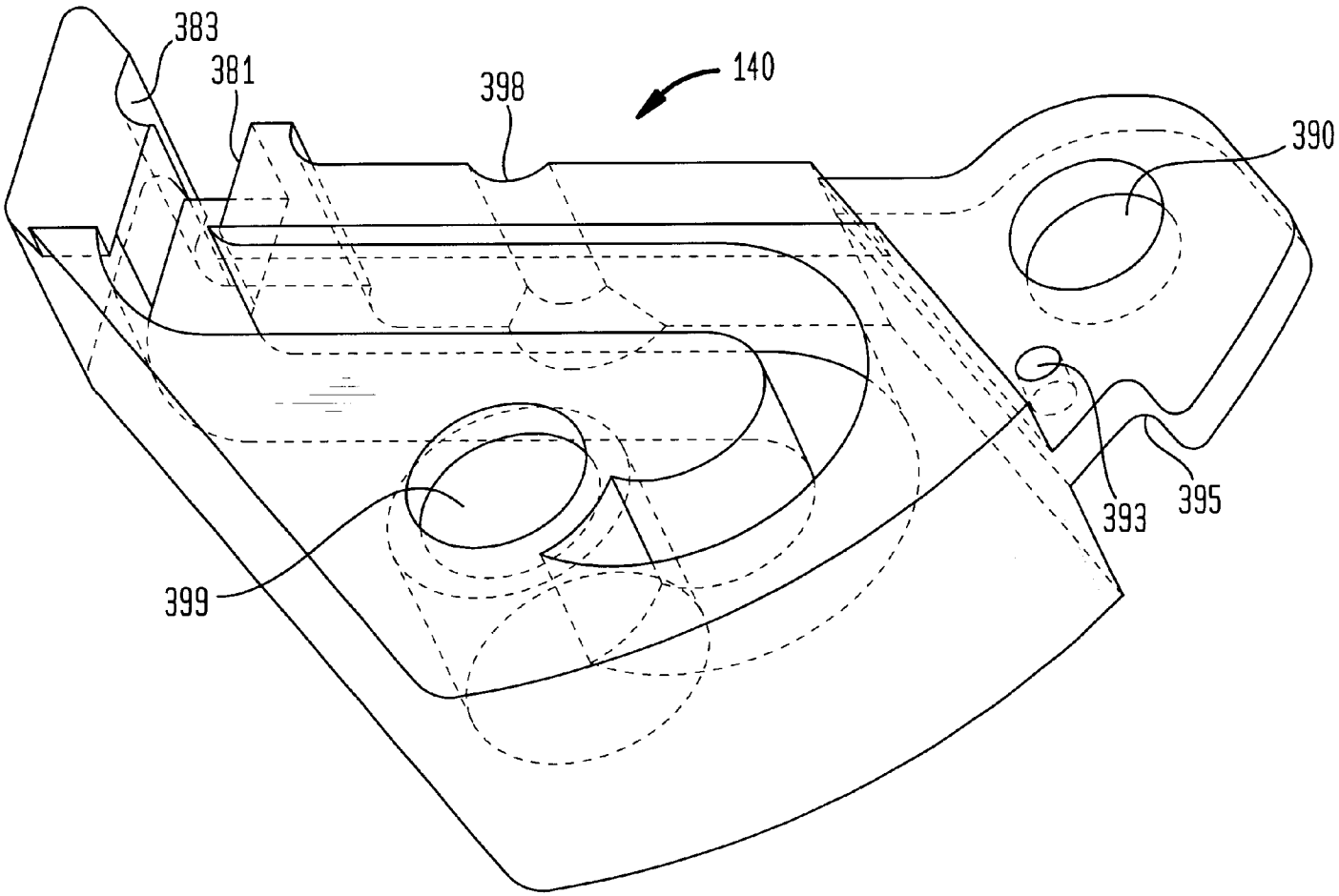
FIG. 3 is enlarged perspective view of a rotor forming part of the fuze of FIG. 1.

In addition, the upward pull force caused by the unfurling of the ribbon 235 translates down to the weight firing pin 185, and causes the latter to move up and away from the rotor 140. Both the rotor 140 and the striker 130 are free to move under the action of their respective springs 160, 170. The burning of the pyrotechnic mix 150 is initiated by the striker firing pin 120 hitting the match tip (miniature detonator) at the open end of a channel in the rotor 140 (FIG. 3). After a delay of approximately 30 to 45 seconds, a main detonator (i.e., a M55 detonator) (FIG. 3B) is functioned. In the meantime, the rotor 140, together with the striker 130, have moved into their respective in-line positions. Upon impact, the firing pin 185 of the weight 180 is forced into the M55 detonator (FIG. 36), thereby igniting the lead charge of the grenade 262. This is the primary mode of operation.

Figure 3A:
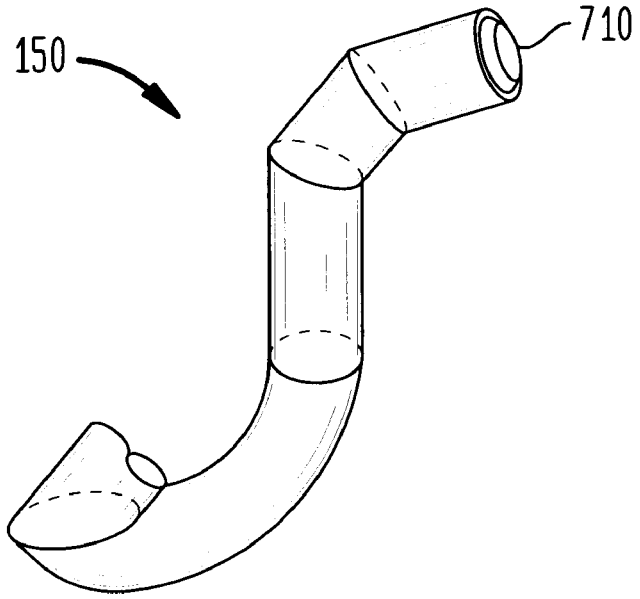
FIG. 3A is an enlarged view of a pyrotechnic mix that fits in a channel in the rotor of FIG. 3.
Figure 3B:
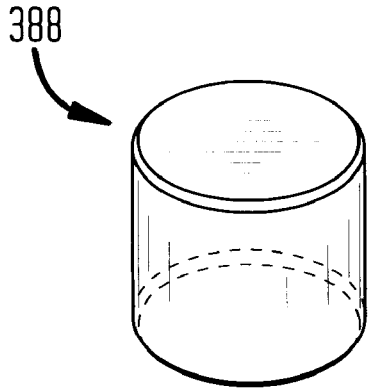
FIG. 3B is an enlarged view of a main M55 detonator that fits within the rotor of FIG. 3.

The secondary/self-destruct mode of operation of the grenade 262 is the initiation of the main M55 detonator (FIG. 3B), by the burning of the pyrotechnic mix 150. If, for any reason, the primary mode fails to detonate the grenade 262, the grenade 262 is rendered safe to handle by the secondary/self destruct mode which sterilizes the main M55 detonator (FIG. 3B).

Having described the main components and operation of the fuze 10, the individual components will now be described in greater detail. With reference to FIG. 1, the bottom plate 100 is a thin piece of stainless steel formed in a stamping operation. The bottom plate 100 includes several features and holes. The bottom plate 100 has a generally round shape to match the shape of the housing 220. The bottom plate 100 includes two spacer holes 301, 302 that are shaped and designed to mate with the spacers 111, 112. These spacer holes 301, 302 are also embossed so their ends do not interfere with the grenade 262 during assembly of the fuze 10. The bottom plate 100 includes two additional holes 610, 611 that allow two grenade studs (not shown) to fit through during assembly of the fuze 10. The bottom plate 100 has a central hole 310 in the center to allow the main lead charge (not shown) of the grenade 262 to be uncovered for impact with the firing pin 120. The bottom plate 100 also includes an uplifted flap 314 that is raised above the top surface of the bottom plate 100 to catch and retain the rotor 140 in the armed condition after the rotor 140 has turned during the arming mode of operation.

With reference to FIG. 1, each spacer 111, 112 is a cylinder with a reduced diameter section at each end. The spacers 111, 112 are machined and made of steel. Each reduced diameter end is forced into a corresponding hole 301, 302, respectively in the bottom plate 100. The other reduced diameter ends of the spacers 111, 112 are forced into corresponding holes 321, 322 in the housing 220. The forced fit between the spacers 111, 112, the housing 220, and the bottom plate 100 binds the fuze 10 together as a solid, unitary item. One of the spacers 111, 112 also functions as a support for the striker spring 170 and the rotor spring 160.

Figure 2:
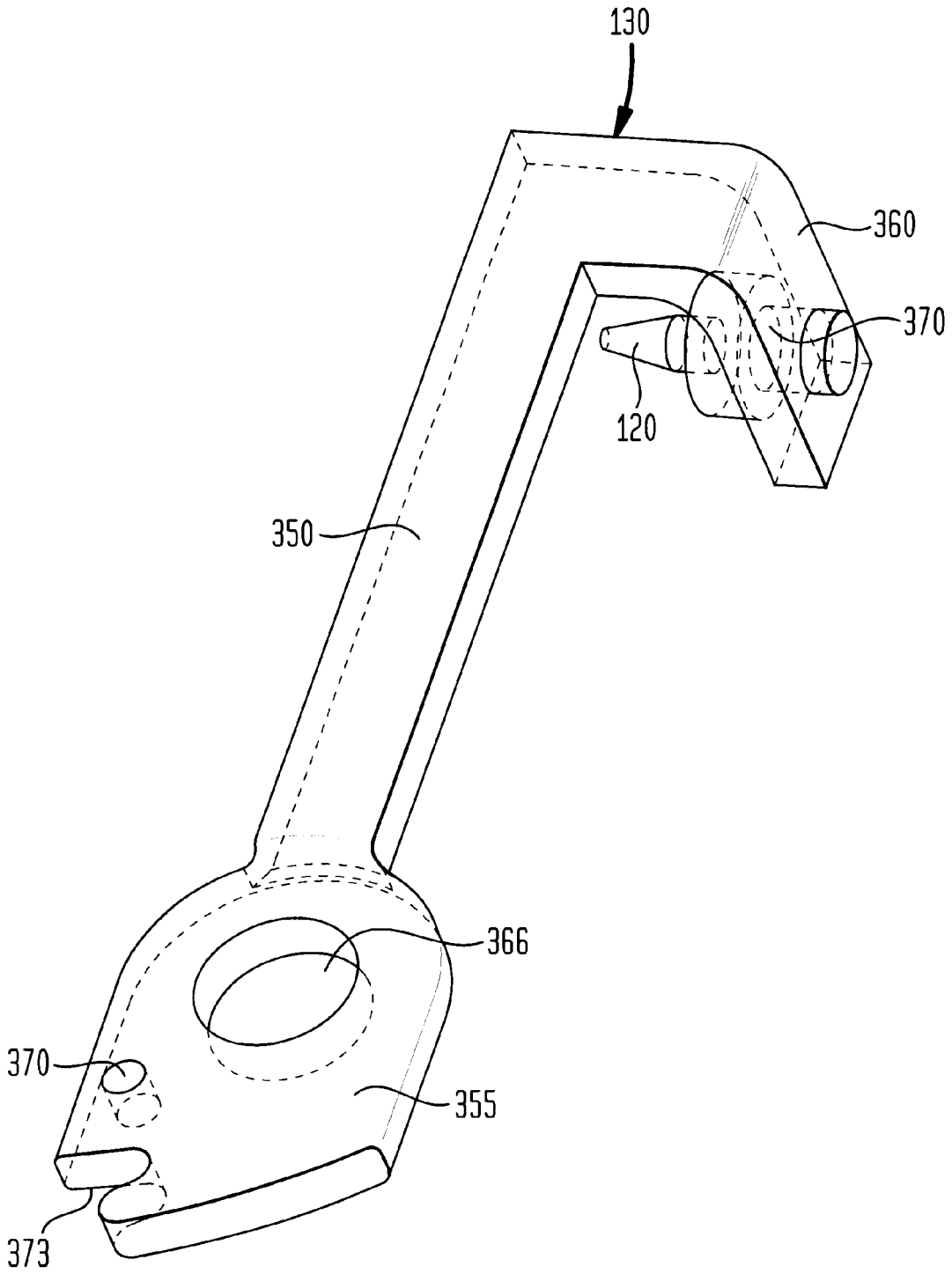
FIG. 2 is enlarged perspective view of a striker forming part of the fuze of FIG. 1.

Referring to FIG. 2, the striker 130 is a stamped piece of stainless steel with a long arm 350 having a rectangular cross-section. The arm 350 extends into a head 355 at one of its ends and a 90 degree tap 360 at its other end. The head includes a hole 366 to allow the striker 130 to be placed and to rotate on the spacer 112. The head 355 is in contact with the rotor 140 and the bottom plate 100, and is held in place by the spacer 112.

The tap 360 is angled at 90 degrees and includes a hole 370 through which the firing pin is fitted. The firing pin 120 is a machined stainless steel part, and is positioned towards the arm 350. The striker spring 170 is attached to the striker 130 and maintains a positive torsional force on the striker 130. The striker 130 is free to rotate on the spacer 112 until the firing pin 120 makes contact with a stab detonator 710 (FIG. 3A). The striker 130 rotates between the rotor 140 and the bottom plate 100. The rotational force is provided by the striker spring 170. The head 355 further includes a hole 370 that receives the handling safety pin 132 (FIG. 1), and an opening 373 that nests with the arc shaped outer shape of the ribbon retainer 240.

Referring now to FIGS. 3, 3A and 3B, the rotor 140 contains the pyrotechnic mix 150 which is placed in a channel 381 and assumes its shape. The channel 381 starts along the large open face 383 of the rotor 140 and ends at the M55 detonator 388. The pyrotechnic mix 150 is initiated by a miniature stab detonator 710 FIG. 3A, which is inserted at the open end 381 of the rotor 140. At the end of the burning delay, the pyrotechnic mix 150 circles the M55 detonator 388 to cause it to ignite and propagate to the main lead charge of the DPICM 262.

The rotor 140 is shaped in a generally right triangle configuration and one end of the triangle is cutaway (FIG. 3 right side) to allow the spacer 111 and the rotor spring 160 to be assembled to the rotor 140. The rotor 140 includes a hole 390 through which the spacer 111 is placed for the rotor 140 to rotate freely around the spacer 111. The rotor 140 moves between the housing 220, the striker 130, and the bottom plate 100.

The rotor 140 further includes a smaller hole 393 that extends through the cutaway end, for the handling safety pin 321 to protrude therethrough, to allow the rotor 140 to be safe for transportation and handling. The rotor 140 also includes a notch 395 to accommodate the ribbon retainer 240. In addition, the rotor 140 includes a shallow cutout 398 that allows the main firing pin 185 of the weight 180 to nest in the side of the rotor 140 in order to prevent the rotational movement of the rotor before the release of the air stream safety locks. The rotor 140 incudes yet another generally cylindrical opening 399 that accommodates the detonator 388 (FIG. 3B).

Figure 4:
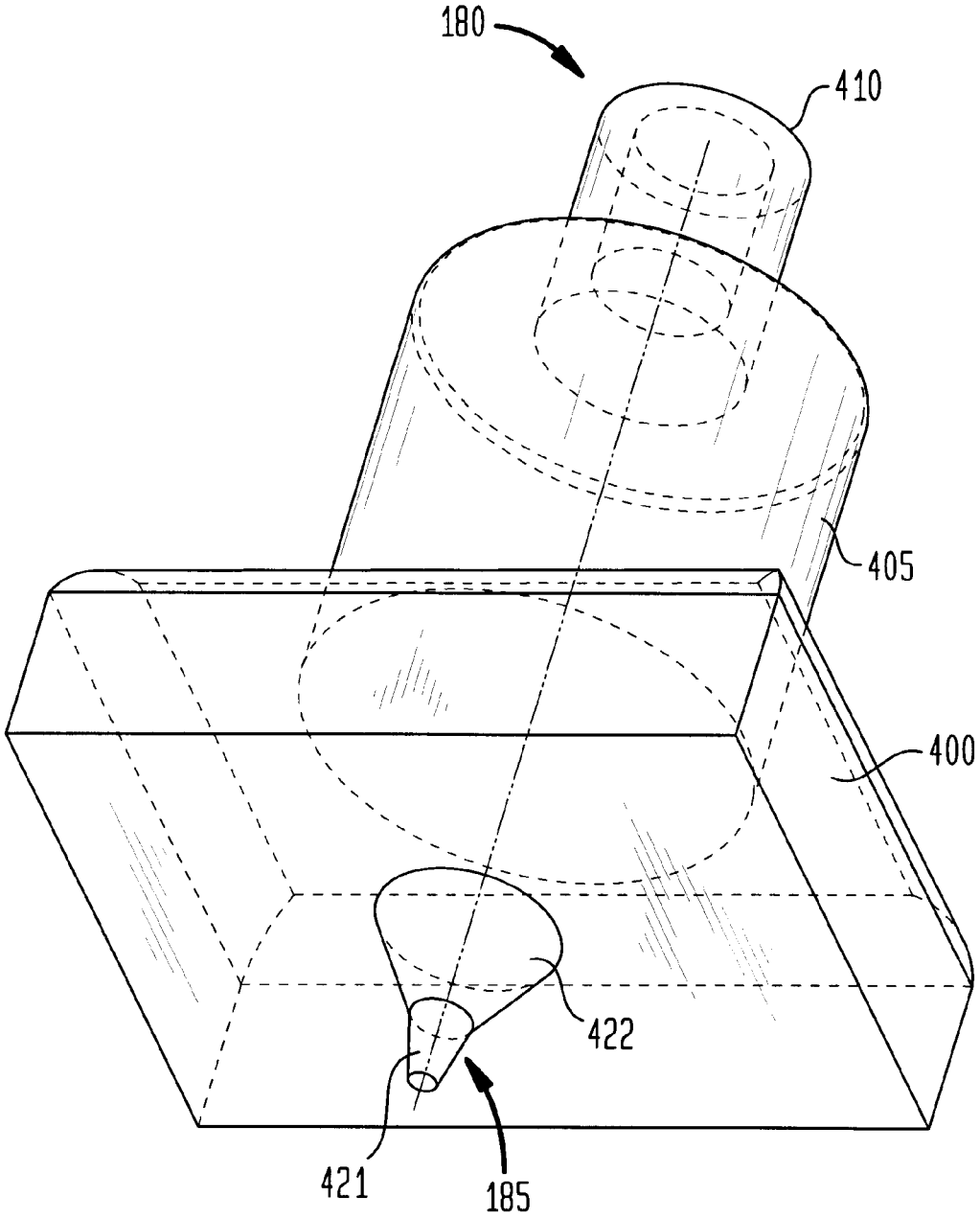
FIG. 4 is enlarged perspective view of a weight forming part of the fuze of FIG. 1.

FIG. 4 shows a detailed sketch of the weight 180 and its firing pin 185. The weight 180 features a support plate 400 having a rectangular shape that enables it to be positioned within the cavity of the housing. A larger solid cylindrical section 405 is secured to the upper face of the support plate 400 to move axially up and down in the large hole of the housing. A smaller, hollow cylindrical section 410 is secured to the upper face of the solid section 405 to be used for staking onto the washer 448 and ribbon 235. The firing pin 180 is formed of two conical sections 421, 422.

The weight 180 can move only up and down in the fuze 10. The top part of the housing 210 is shaped on the inside, to conform to the larger cylindrical section 405 of the weight 180. The smaller, hollow cylindrical section 410 protrudes through a hole 444 (FIG. 1) in the upper face of the housing 210, and is crimped after a washer 448 (FIG. 1) is inserted around the section 410.

The weight spring 190 rests on the larger cylindrical section 405 and on the inner upper face of the housing 210, and surrounds the smaller cylindrical section 410. The weight spring 190 helps to keep the weight 190 down, with its firing pin 185 nested in the side of the rotor 140 during assembly of the fuze 10. It also helps in pushing down the weight 180 during the primary mode of operation of the fuze 10.

Figure 5:
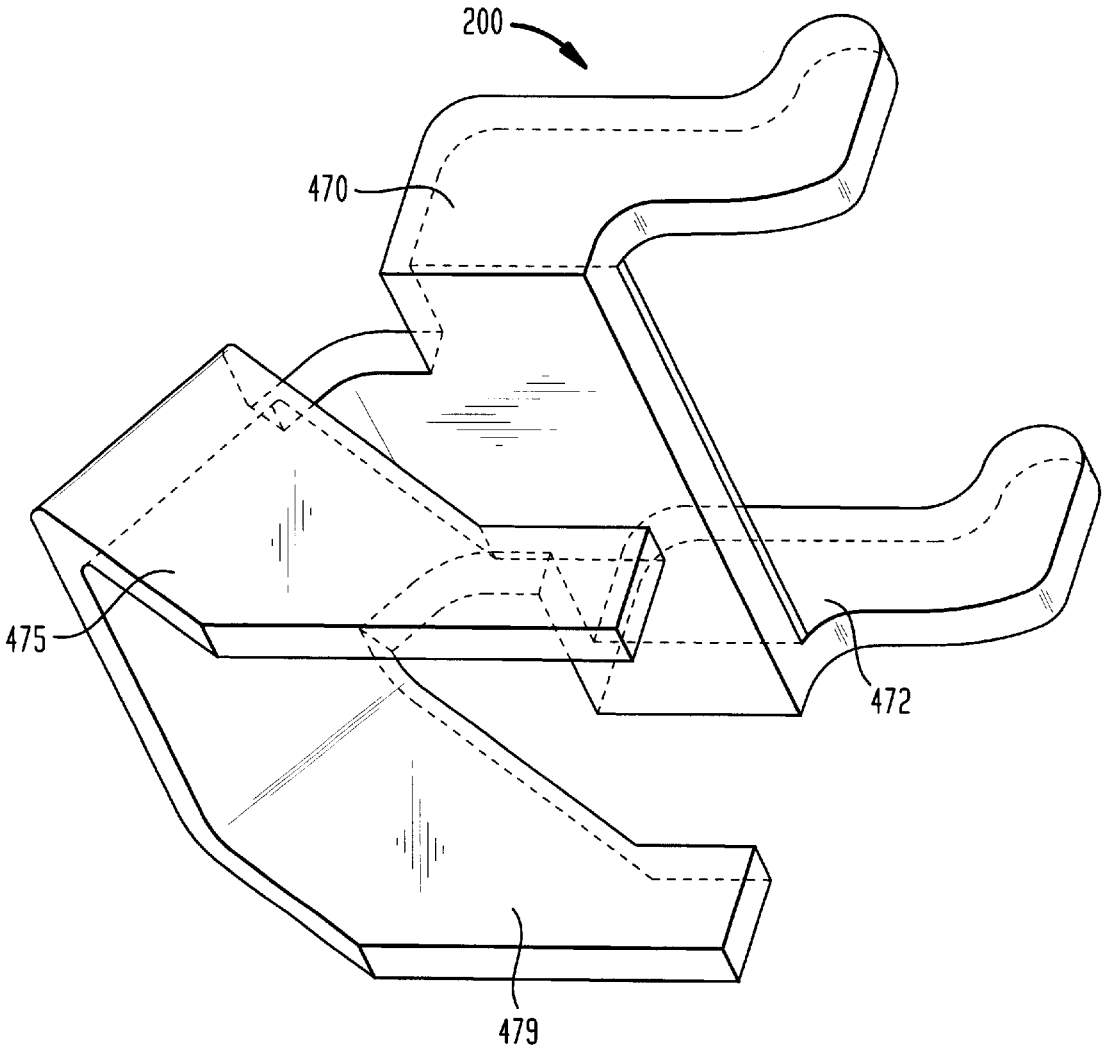
FIG. 5 is enlarged perspective view of a bore rider forming part of the fuze of FIG. 1.
Figure 6:
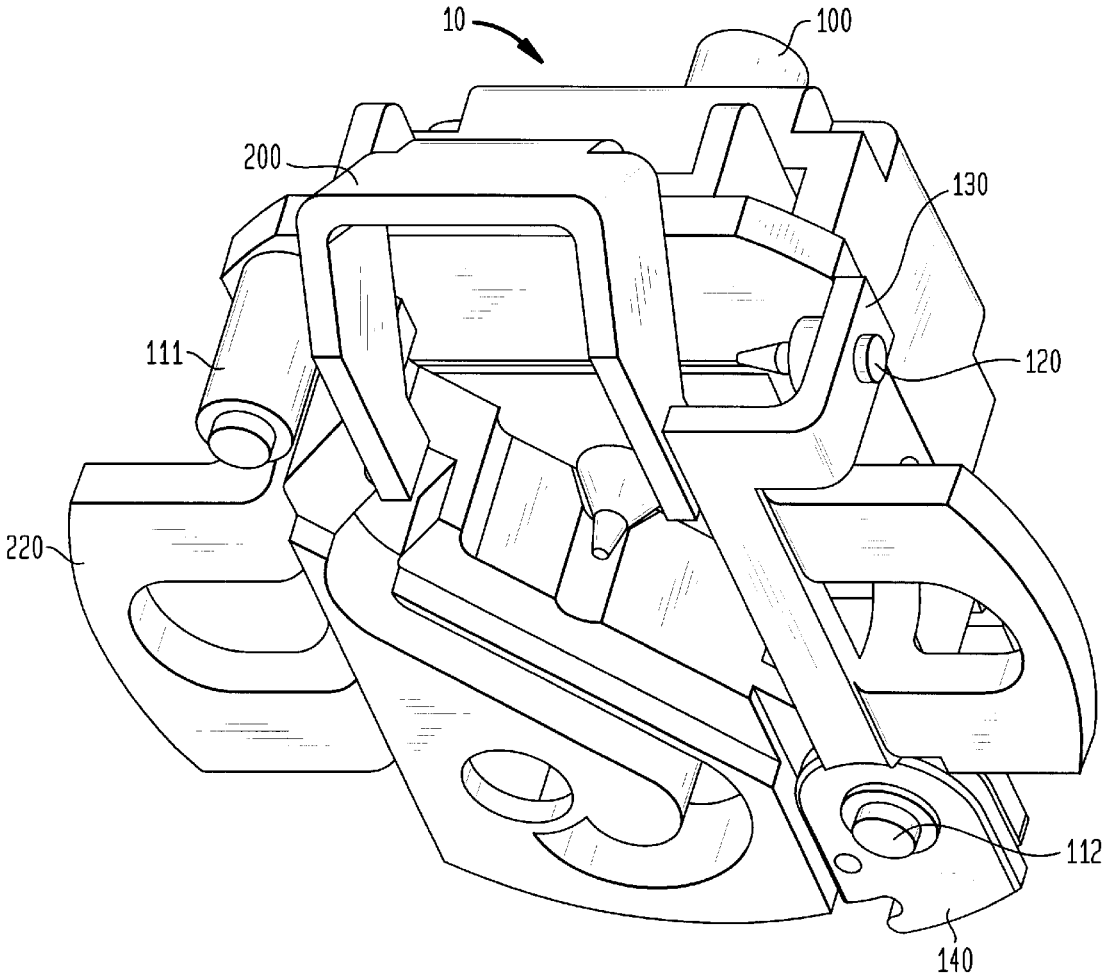
FIG. 6 is a bottom view of the fuze of FIG. 1 shown assembled.
Figure 7:
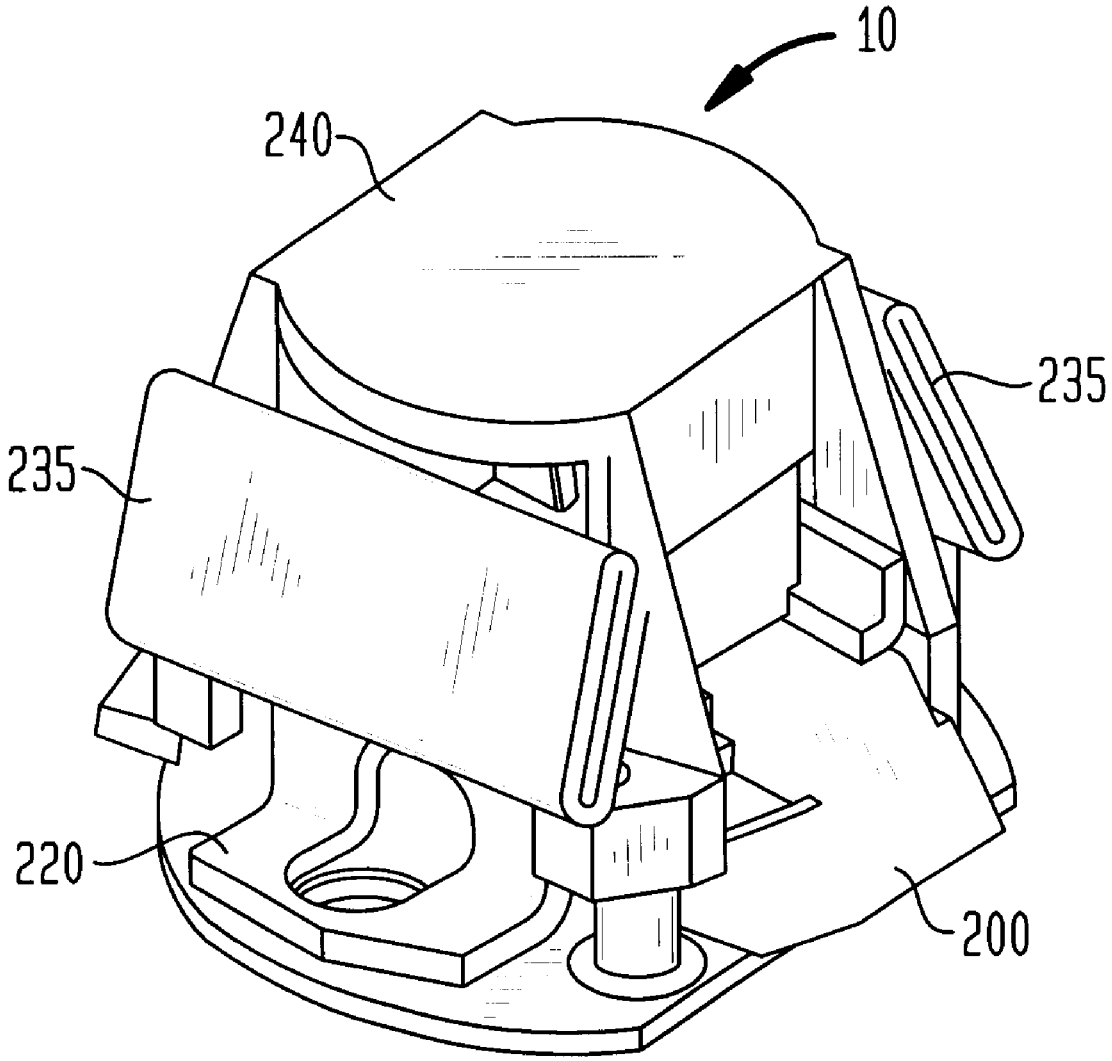
FIG. 7 is a perspective view of the fuze of FIG. 1 shown fully assembled.

FIG. 5 illustrates the bore rider 200 that presents several functions. The bore rider 200 can be made of stainless steel in a stamping operation, or alternatively as a plastic molded part. The thickness of the bore rider 200 is approximately 0.02 inch, but other dimensions can also be used. When the fuze 10 is assembled, it is primarily the bore rider 200 that keeps it in the unarmed condition. When the bore rider 200 is removed from the fuze 10 by the force of the air stream, the fuze 10 moves into the armed condition. This is true for both the primary mode of operation and the secondary self-destruct mode.

The bore rider 200 includes four leaves: two top leaves 470, 472, and two bottom leaves 475, 479. The bottom leaves 475, 479 enter the housing 220 through slots 520 and 521 in the side of the housing 220, and keep the spring loaded rotor 140 and the striker 130 apart. The top leaves 470, 472 also enter the housing 220 through the same side 520, 521 of the housing 220. The function of the top leaves 470, 472 is to press down on the support plate 400 FIG. 4) of the weight 180, to keep the weight firing pin 185 nested in the side 398 of the rotor 140, thereby helping to keep the rotor 140 in the off-line position. In addition, the support plate 400 that holds the bottom leaves 475, 479, creates, together with the side 530 (FIG. 9) of the housing 222 a cove (or pocket) 530 that traps the air stream after the grenade 262 has been ejected from the carrier, which results in the separation of the bore rider 200 from the remaining elements of the fuze 100.

The bore rider 200 is kept in place by the bore rider spring 210. The bore rider spring 210 is inserted between the bore rider 200 and the housing 220 and kept under tension in order to apply force against the point of contact between the upper tabs and the surface resting on the tabs. This locks the bore rider into position and only allows for an initial upwards movement. Between the bore rider and the DPICM.

The housing 220 is illustrated in FIGS. 1, 6, 7, 9, and 10, and is the main structural component of the fuze 10. It houses all the other components, and is designed to allow the fuze 10 to be fitted onto the grenade 262.

The handling safety pin 230 is used for both interplant shipment of the complete fuze 10 to the ammunition load plant and for safety and handling during staking to the grenade 262. It is inserted through the hole 321 in the housing 220, an opening in the rotor 140, and an opening in the striker 130, thereby preventing movement of the rotor 140 and the striker 130 during handling and transportation.

The ribbon retainer 240 acts as a safety lock that locks out the movement of the rotor 140 and the striker 130 by locking in the notch 373 of the striker 130, and in the notch 395 of the rotor 140. The ribbon retainer 240 also covers and protects the ribbon 235 during loading and grenade ejection from the carrier.

It should be understood that the geometry and dimensions of the components described herein may not be to scale, and may be modified within the scope of the invention. The embodiments described herein are included for the purposes of illustration, and are not intended to be the exclusive; rather, they can be modified within the scope of the invention. Other modifications may be made when implementing the invention for a particular application.

What is claimed is:

1. A self-destruct fuze comprising:

a rotor;

a striker;

a weight having a firing pin, for preventing the rotor from moving into an armed in-line position;

a housing;

a bottom plate for securing the rotor, the striker, and the weight inside the housing, with the striker and the rotor rotating along a top surface of the bottom plate; wherein the bottom plate includes a lock out tab that protrudes towards the rotor to prevent a return movement of the rotor after the rotor has moved into an in-line position, and a bore rider for retaining the weight and the rotor prior to firing.

2. The fuze according to claim 1, further including at least one spacer which is secured to the bottom plate.

3. The fuze according to claim 2, wherein the firing pin rotates along with the striker into the rotor, so that the firing pin is forced to strike a match tip of a pyrotechnic mix.

4. The fuze according to claim 3, further including a striker spring that provides a torsion force to drive the striker.

5. The fuze according to claim 4, further including a rotor spring that provides a torsion force to drive the rotor.

6. The fuze according to claim 5, further including a handling safety pin.

7. The fuze according to claim 6, further including a ribbon and a ribbon retainer; and wherein the ribbon retainer locks out the movement of the rotor and the striker, and protects the ribbon during loading.

8. The fuze according to claim 7, further including a bore rider spring that contains the bore rider.

9. The fuze according to claim 8, wherein the bottom plate includes two spacers that are secured to the bottom plate, and two spacer holes that are shaped to mate with the two spacers.

10. The fuze according to claim 9, wherein the bottom plate further includes a central hole that allows a main lead charge to be uncovered for impact with the firing pin.

11. The fuze according to claim 10, wherein the striker includes an elongated arm that extends into a head at one of its ends and a tap at another end, wherein the tap is disposed at an angle relative to the arm.

12. The fuze according to claim 11, wherein the head includes a hole that allows the striker to be placed on and to rotate around one of the two spacers.

13. The fuze according to claim 12, wherein the tap includes a hole through which the firing pin is fitted.

14. The fuze according to claim 13, wherein the head includes a hole that receives the handling safety pin.

15. The fuze according to claim 14, wherein the pyrotechnic mix is placed in a channel formed within the rotor, and generally assumes the shape of the rotor.

16. The fuze according to claim 15, wherein the rotor includes a hole through which one or the two spacers is placed for the rotor to rotate freely around the spacer.

17. The fuze according to claim 16, wherein the rotor includes a cutout that allows the firing pin of the weight to prevent the rotational movement of the rotor prior to firing.

18. The fuze according to claim 17, wherein the weight includes:

a support plate;

a solid cylindrical section secured to an upper face of the support plate; and a hollow cylindrical section secured to an upper face of the solid section.

19. The fuze according to claim 18, wherein the firing pin is formed of two conical sections.

20. The fuze according to claim 19, wherein the bore rider includes two top leaves and two bottom leaves that engage the housing.

* * * * *